United States Patent [19]

Lindquist

[11] Patent Number: 4,470,201

[45] Date of Patent: Sep. 11, 1984

[54] SEAM LINE MARKER

[76] Inventor: David E. Lindquist, 1639-12th Ave., Rockford, Ill. 61108

[21] Appl. No.: 467,021

[22] Filed: Feb. 16, 1983

[51] Int. Cl.[3] ..... B43L 13/00

[52] U.S. Cl. ..... 33/430; 33/2 H

[58] Field of Search ..... 33/2, 437, 430, 403, 33/32 B, 32 C, 32 R, 454, 446; 30/293

[56] References Cited

U.S. PATENT DOCUMENTS

| | | | |
|---|---|---|---|
| 87,626 | 3/1869 | Bowly | 33/443 |
| 714,545 | 11/1902 | Whitehouse | 33/446 |
| 797,799 | 8/1905 | Fay | 33/430 |
| 884,219 | 4/1908 | Scates | 83/609 X |
| 944,094 | 12/1909 | Hilton . | |
| 977,544 | 12/1910 | Payne | 33/446 |
| 1,667,150 | 4/1928 | Griffith | 33/443 |
| 1,759,989 | 5/1930 | Leaman . | |
| 1,979,789 | 11/1934 | Barrett . | |
| 2,251,866 | 8/1941 | Browning . | |
| 2,574,148 | 11/1951 | Hutkin et al. . | |
| 2,863,591 | 12/1958 | Butler . | |
| 4,038,751 | 8/1977 | Albright | 33/403 X |

FOREIGN PATENT DOCUMENTS

| | | | |
|---|---|---|---|
| 11791 | of 1928 | Australia | 33/430 |

*Primary Examiner*—Harry N. Haroian

*Attorney, Agent, or Firm*—Leydig, Voit, Osann, Mayer & Holt, Ltd.

[57] ABSTRACT

A seam marker includes a flat base with an upstanding shoulder so that a piece of cloth may be placed on the base with an edge against the shoulder. An elongated strip extends over the cloth with a straight edge parallel to the shoulder and the strip is secured to the base and is resilient so that it may be pressed down against the cloth to clamp the latter against the base at which time a seam line may be marked along the straight edge of the strip.

2 Claims, 6 Drawing Figures

SEAM LINE MARKER

BACKGROUND OF THE INVENTION

This invention relates to a device for marking a seam line on a piece of cloth and particularly for instances where the quality of the article made from the cloth depends upon the accuracy of the location of seam lines. An example of such an article is a quilt.

SUMMARY OF THE INVENTION

The general object of the invention is to provide a new and improved seam marker which is comparatively simple and inexpensive to manufacture and which, at the same time, permits a seam to be marked quickly, easily and accurately.

A more detailed object is to achieve the foregoing by making the marker with a flat base having an upstanding shoulder so that a piece of cloth may be placed on the base with an edge against the shoulder and by using an elongated strip which has a straight edge paralleling the shoulder and which is resiliently mounted on the base so that the strip may be pressed down against the cloth to clamp the latter against the base and then the seam line may be drawn along the straight edge on the strip.

Another object is to construct the marker in a novel manner so that the strip may selectively be positioned different distances from the shoulder whereby seams of different widths may be marked.

DETAILED DESCRIPTION OF THE PREFERRED EMBODIMENT

Figure 4:
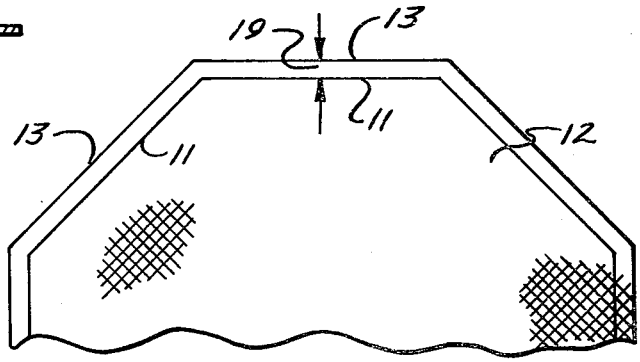
FIG. 4 is a fragmentary plan view of a piece of cloth with the seam lines marked thereon.

As shown in the drawing for purposes of illustration, the invention is embodied in a device 10 used for marking the seam lines 11 (FIG. 4) on a piece of cloth such as a hexagonal piece 12 used in making a quilt. Usually it is important that each line 11 be drawn accurately so that the line is parallel to the adjacent edge 13 of the cloth and the spacing between the line and the edge is the desired amount and is uniform from line to line. In the absence of such accuracy, the product made from the cloth pieces usually will not be of acceptable quality. In quilting, for example, inaccurate placement of the lines 11 results in wrinkling, distortion of the pattern and the like and these defects are compounded each time a piece with inaccurately drawn lines is added to the quilt.

The present invention contemplates the provision of a novel seam marking device 10 which is comparatively simple in construction and easy to use and which accurately locates the seam line 11 so that the latter is parallel to the edge 13 and is spaced from the edge the desired distance. To these ends, the device includes a base 14 with a flat surface 15 and a straight raised or upstanding shoulder 16 so that the cloth piece 12 may be laid on the surface with the edge 13 of the piece abutting the shoulder. A comparatively rigid elongated strip 17 is disposed above the surface 15 and has a straight edge 18 which is spaced from but is parallel to the shoulder 16. Means resiliently supports the strip for movement between a normal position in which the strip is spaced above the base surface 15 and an active position in which the strip is pressed against the cloth on the base and clamps the cloth against the surface. The edge 18 of the strip is spaced from the shoulder 16 a distance equal to the desired distance 19 (FIG. 4) that the seam line 11 is spaced from the cloth edge 13. Thus, when the strip 17 is clamping the cloth against the surface 15 with the edge 13 of the cloth against the shoulder 16 as shown in FIG. 2, a marker may be drawn along the edge 18 to mark the seamline on the cloth.

Figure 1:
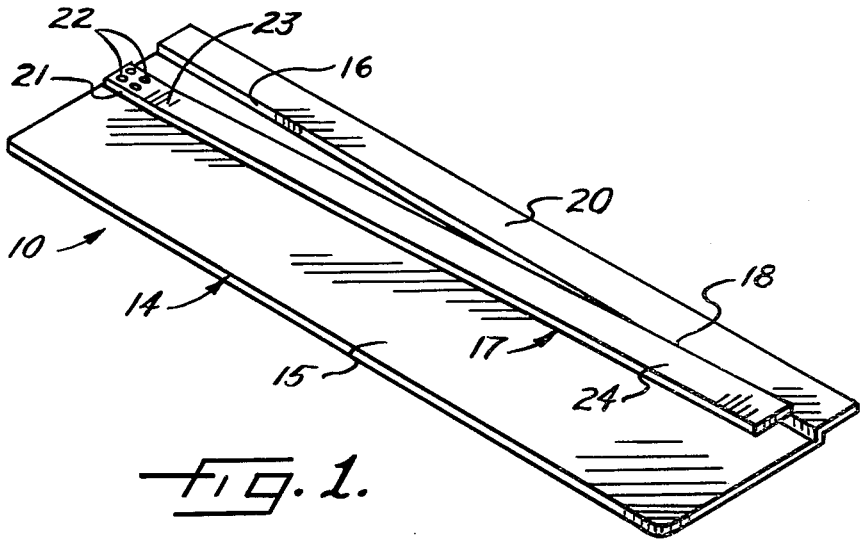
FIG. 1 is a perspective view of the seam line marker embodying the present invention.

In the present instance, the base 14 is a rectangular piece of sheet metal stamped to raise the marginal portion 20 along one of the long edges of the base so that the balance of the base provides the surface 15 and the raised portion defines the shoulder 16. As illustrated in FIGS. 1 and 2, the latter extends from one end of the base to the other. The strip 17 also is made from sheet metal and extends along substantially the full length of the base.

Although various means may be used to mount the strip 17 resiliently for movement between the normal and active positions, herein this means is a portion of the strip. Thus, the strip is made from a material which is resilient and one end portion 21 of the strip is fastened to the base 14 as by spot welds 22. Inside the end portion 21 is an intermediate flexing portion 23 which is inclined upwardly from the base so that the main body portion 24 of the strip normally is spaced above the surface 15. When the body portion is pushed downwardly, the portion 23 resiliently flexes and permits the body portion to be pressed against the cloth 12 and clamp the latter against the base as illustrated in FIGS. 2 and 3. When the strip is released, the flexing portion causes the body portion to spring back up to its normal position.

Figure 2:
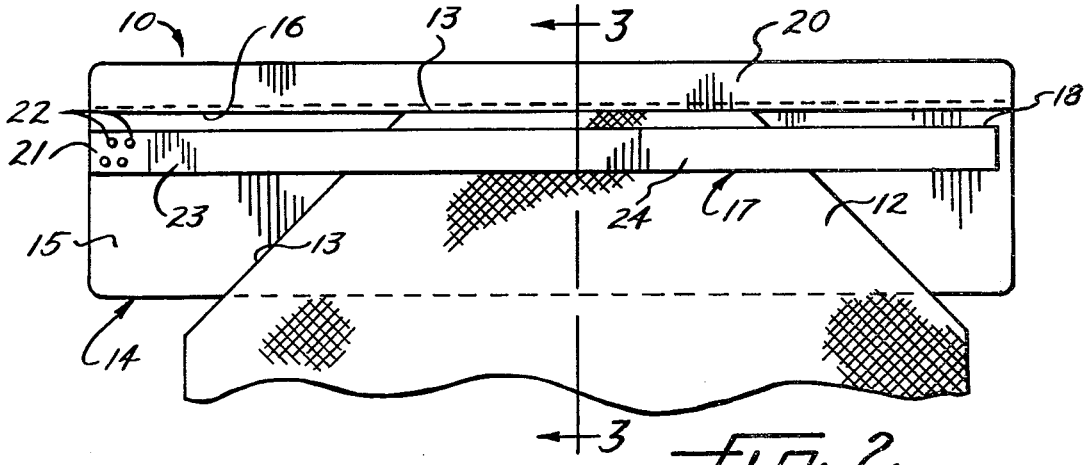
FIG. 2 is an enlarged plan view of the marker.
Figure 3:
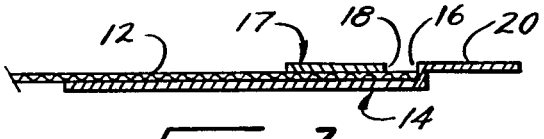
FIG. 3 is an enlarged sectional view taken along the line 3—3 in FIG. 2.
Figure 5:
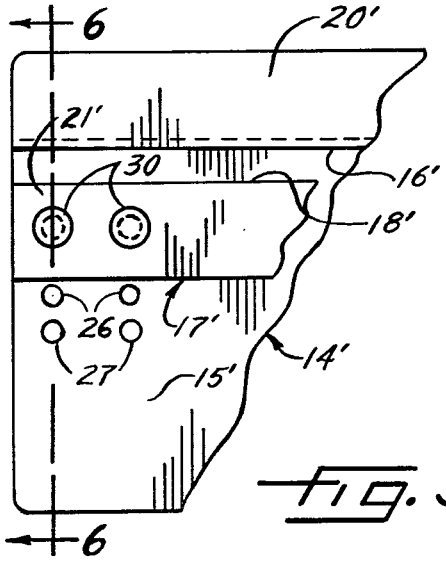
FIG. 5 is a fragmentary plan view of a modified form of the marker.
Figure 6:
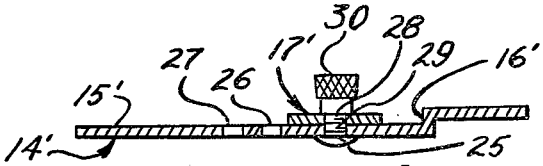
FIG. 6 is a sectional view taken along the line 6—6 in FIG. 5.

A quarter-inch seam is commonly used for quilting and, in the embodiment shown in FIGS. 1, 2 and 3, the strip 17 is permanently welded to the base 14 in the position in which the edge 18 of the strip is spaced one-fourth of an inch from the shoulder 16. In some cases, however, it is desirable that the device be capable of marking seams of different widths and, for this purpose, the position of the strip 17' relative to the shoulder 16' is adjustable in the modified form shown in FIGS. 5 and 6. For this purpose, the base 14' is provided with a plurality of pairs of holes, in this case three pairs 25, 26 and 27, and the end portion 21' of the strip 17' is formed with a matching pair of holes 28. The holes in the base are formed at the edge of surface 15' and the centers of the holes of each pair are on a line which is parallel with the shoulder 16'. Similarly, the centers of the holes in the strip are on a line which is parallel to edge 18' of the strip so that, when the holes in the strip are matched with any of the pairs of holes in the base, the edge 18' is parallel with shoulder 16'. With the holes thus matched, the end portion 21' is clamped to the base. Thus, with the holes 28 over the holes 25 as illustrated, fastening elements such as screws 29 are projected up through the holes and thumb nuts 30 are threaded onto the screws and bear against the end portion 21' to clamp the latter against the surface 15'. By using different pairs of holes, the edge 18' may be located different distances from the shoulder 16'. For example, the spacing might be one-fourth of an inch when using the holes 25, five-eighths of an inch when using the holes 26 and seven-eighths of an inch when using the holes 27.

It will be observed that, with a device 10 as described above, seam lines 11 may be marked quickly, easily and accurately on a piece of cloth 12. All that is required is to lay the cloth on the surface 15, slide the cloth on the surface until an edge 13 abuts the shoulder 16, press the strip 17 down and mark along the edge 18. When the strip is released, it springs back up so that the cloth may be removed or turned to mark a seam line along another edge. If the pairs of holes 25, 26 and 27 are used, the device may quickly be adjusted to mark seams of different widths.

I claim:

1. A device for marking a seam on a piece of cloth, said device comprising, a unitary sheet metal stamping having a flat base portion, an elongated straight shoulder portion upstanding perpendicularly from an edge of said base portion, and a margin portion extending away from said shoulder portion on the side opposite said base portion, said base portion having a flat upper surface adjacent said shoulder portion, whereby a piece of cloth may be laid on said surface with an edge of the cloth abutting said shoulder portion, a comparatively rigid but flexible elongated strip disposed above said surface and having a straight edge paralleling said shoulder portion and spaced from the latter a preselected distance, said strip having an end portion, a body portion and an intermediate portion between said end and body portions, said end portion lying against said surface and said intermediate portion extending upwardly to support said body portion in a normal position spaced above said surface, said intermediate portion flexing as said body portion is manually moved toward said surface to press a piece of cloth against the surface and said intermediate portion resiliently returning the body portion to said normal position when the body portion is released, said body portion when in said normal position permitting a piece of cloth to be placed on said surface with a selected edge of the cloth against said shoulder portion and when in said active position to clamp the cloth against the surface while a seam line is drawn on the cloth along the straight edge of said strip, and means fastening said end portion to said base portion.

2. A device as defined in claim 1 in which said means is selectively operable to mount said strip on said base portion with said straight edge located at different distances from said shoulder portion and includes a plurality of pairs of holes formed in said base portion, a pair of holes in said end portion overlying a selected pair of holes in said base portion, and fastening elements through the holes of said selected pair and through the holes in said end portion, said pairs of holes being spaced different distances from said shoulder portion.

* * * * *